US009980049B2

(12) United States Patent
Koh et al.

(10) Patent No.: US 9,980,049 B2
(45) Date of Patent: May 22, 2018

(54) SPEAKER FOR REPRODUCING SURROUND SOUND

(75) Inventors: Swee Leong Alvin Koh, Singapore (SG); Kok Huan Ong, Singapore (SG)

(73) Assignee: Creative Technology Ltd, Singapore (SG)

( * ) Notice: Subject to any disclaimer, the term of this patent is extended or adjusted under 35 U.S.C. 154(b) by 169 days.

(21) Appl. No.: 14/117,019

(22) PCT Filed: Apr. 26, 2012

(86) PCT No.: PCT/SG2012/000150

§ 371 (c)(1), (2), (4) Date: Nov. 11, 2013

(87) PCT Pub. No.: WO2012/154124

PCT Pub. Date: Nov. 15, 2012

(65) Prior Publication Data

US 2014/0086437 A1 Mar. 27, 2014

(30) Foreign Application Priority Data

May 11, 2011 (SG) ..... 201103376

(51) Int. Cl.

*H04R 5/02* (2006.01)
*H04R 5/04* (2006.01)
*H04S 5/00* (2006.01)

(52) U.S. Cl.

CPC ..... *H04R 5/04* (2013.01); *H04S 5/005* (2013.01); *H04R 2420/07* (2013.01)

(58) Field of Classification Search

CPC ..... H03G 5/005; H03G 5/025; H03G 5/165; H04R 1/24; H04R 1/345; H04R 5/02;
(Continued)

(56) References Cited

U.S. PATENT DOCUMENTS 5,361,381 A * 11/1994 Short ..... H04R 29/001 381/100
5,870,484 A * 2/1999 Greenberger ..... H04R 5/02 381/17

(Continued)

FOREIGN PATENT DOCUMENTS

CN 101138246 A 3/2008
CN 101248483 A 8/2008

(Continued)

*Primary Examiner* — Lun-See Lao
(74) *Attorney, Agent, or Firm* — Russell Swerdon; Desmund Gean

(57) ABSTRACT

The present invention relates to a speaker, and a method and surround sound system for processing multi-channel audio signals in each of a plurality of audio output sources for generation of surround sound in a listening area. In particular, the system comprises a transmitter for transmitting a left channel (L) signal and a right channel (R) signal to a speaker. The speaker comprises a processing unit configured to (a) receive an audio signal having a left channel (L) signal and a right channel (R) signal; (b) process separately and independently the L and R audio signals to produce processed signals; and (c) mix the processed signals to produce the surround sound signal.

25 Claims, 10 Drawing Sheets

(58) Field of Classification Search
CPC .. H04R 2420/07; H04R 2499/11; H04R 3/04; H04R 3/14; H04R 5/04
USPC .. 381/300, 309, 307, 1, 98, 97, 27, 310, 61, 381/17–22
See application file for complete search history.

(56) References Cited

U.S. PATENT DOCUMENTS

| | | | | |
|---|---|---|---|---|
| 6,449,371 | B1 * | 9/2002 | Tan | H04S 3/02 381/119 |
| 6,487,296 | B1 * | 11/2002 | Allen | H04H 20/89 381/80 |
| 8,050,424 | B2 | 11/2011 | Noro | |
| 2004/0125967 | A1 * | 7/2004 | Eid | H04S 3/02 381/99 |
| 2008/0159545 | A1 * | 7/2008 | Takumai | H04R 1/403 381/17 |
| 2008/0272721 | A1 * | 11/2008 | Mayes | H02P 25/08 318/400.17 |
| 2008/0273721 | A1 * | 11/2008 | Walsh | H04S 5/00 381/300 |
| 2008/0285762 | A1 * | 11/2008 | Iwamoto | H04R 5/02 381/17 |

FOREIGN PATENT DOCUMENTS

| | | | | |
|---|---|---|---|---|
| CN | 101902679 | A | 12/2010 | |
| GB | 2448980 | A | 11/2008 | |
| JP | 06-6290407 | * | 10/1994 | G11B 5/09 |
| WO | 99/34643 | A1 | 7/1999 | |

* cited by examiner

SPEAKER FOR REPRODUCING SURROUND SOUND

FIELD OF THE INVENTION

The present invention relates to a speaker. In particular, it also relates to a method and surround sound system for processing multi-channel audio signals in each of a plurality of audio output sources for generation of surround sound in a listening area.

BACKGROUND OF THE INVENTION

Existing surround sound recording formats include those referred to as 5.1, 6.1 and 7.1. The 5.1 surround format comprises a compressed data stream containing five channels, generally designated left, center, right, surround left, and surround right, named for the speaker positions for which the channel information is intended. A low frequency effects channel is formed by a combination of the five other channels, and may be provided to a sub-woofer. The 6.1 surround format includes the same five channels as the 5.1 surround format, but adds a surround back channel, which may be fed to one or more back speakers in a surround sound system. The 7.1 surround format is similar to the 5.1 surround format, but has two surround side channels (surround side left and surround side right) rather than a single back channel, for a total of seven channels. Thus, the 5.1 surround format has two surround channels (surround left and right), the 6.1 surround format has three surround channels (surround left, right and back), and the 7.1 surround format has four surround channels (surround side left and right, and surround back left and right).

Basic surround system speaker configurations generally include from six to eight speakers placed at conventionally well-established locations, according to the type of surround format they are intended to play. A six-speaker surround system typically includes left, right and center speakers (with the right and left speakers spaced widely apart), a sub-woofer, and surround left and right speakers (which may be monopolar or dipolar in nature). A seven-speaker surround system typically includes the same speaker arrangement as the six-speaker surround system, but adds a back surround speaker. An eight-speaker surround system typically includes the same speaker arrangement as the six-speaker surround system, but adds a back left surround speaker and a back right surround speaker.

The enjoyment experienced by a listener in a surround sound system can be affected by a number of factors, including the listener's physical position relative to the various speakers, as well as by the particular format of the audio track being played on the system.

However, there are problems in the abovementioned conventional surround sound systems. For example, conventional 7.1 systems are not capable of being expanded, i.e. the number of speakers cannot be increased. Therefore, a user does not have the flexibility of adding speakers or changing the configuration of speakers in accordance with the user requirements. Further, conventional 7.1 systems have complicated wiring set-up procedures and it is difficult for a novice person to set up such systems easily. However, wired connections are necessary in setting up conventional surround sound systems because the signals after being processed and amplified in an audio/video receiver and amplifier unit are too large to be transmitted to output sources.

Wireless solutions have been developed for stereo systems. However, present wireless systems only provide for the transmission of audio signals between one transmitter and one receiver. Disadvantageously, this system requires the use, of multiple transmitters. Still further, conventional stereo systems cannot be transformed or converted to generate surround sound because the stereo systems are not capable of digital signal processing. By doing so, the sound quality, and ultimately the surround sound experienced by a listener, deteriorates.

Accordingly, it would be advantageous to provide an improved surround sound system which overcomes one or more of the foregoing problems or shortcomings.

SUMMARY OF THE INVENTION

In accordance with a first aspect of the present invention, there is provided a speaker for generating a surround sound signal, the speaker comprising a processing unit configured to: (a) receive an audio signal having a left channel (L) signal and a right channel (R) signal; (b) process separately and independently the L and R audio signals to produce processed signals; and (c) mix the processed signals to produce the surround sound signal.

By "mix", it is meant to include any audio mixing process known to the skilled person. Without undue limitation, it includes the mixing of audio signals by which a multitude of audio signals may be combined into one or more channels, most commonly two-channel stereo. By "surround sound signal", it is meant to include the audio output produced by the processed audio signals. It is also meant to include one, two (for example, left and right audio signals) or any number of signals that is generated to produce the surround sound signal.

Preferably, the processing unit is further configured to filter the received audio signal such that the output surround signal is filtered.

Preferably, the processing unit is further configured to process the received audio signal according to one of: an equalisation characteristic; and a dynamic range characteristic.

Preferably, the speaker further comprises an amplifier configured to amplify the processed signals.

Preferably, the processing unit includes a wireless receiver to receive the L and R signals.

Preferably, the left channel signal has a junction which splits the left channel signal into a first portion and a second portion. More preferably, the first portion signal is processed by a high pass filter, an equaliser, an all pass filter and a dynamic range control; and the second portion signal is processed by a high pass filter, an equaliser, a low pass filter and a dynamic range control.

Preferably, the speaker comprises left and right drivers, and the processed left and right channel signals are channelled to left and right drivers respectively. More preferably, the processed right channel signal channelled to the right driver is out of phase to the processed left channel signal channelled to the right driver.

Preferably, the high pass filter is configured to have a cut-off frequency of 70-200 Hz. More preferably, the high pass filter is configured to have a cut-off frequency of 200 Hz.

Preferably, the low pass filter is configured to have a cut-off frequency of 1200 Hz.

Preferably, the speaker is coupled to a sub-woofer unit, the sub-woofer unit comprises a low frequency effects channel formed by a combination of the L and R audio signals.

Preferably, the sub-woofer unit comprises a processing unit including any one selected from the group: a high pass filter, a low pass filter, an equaliser, and a dynamic range control.

Preferably, the low pass filter has a cut-off frequency of 70-200 Hz.

Preferably, the sub-woofer has 12 dB boost at about 180 Hz.

In accordance with a second aspect of the present invention, there is provided a method for generating a surround sound signal in a speaker, the method comprising: (a) receiving an audio signal having a left channel (L) signal and a right channel (R) signal; (b) processing separately and independently the L and R signals to produce processed signals; and (c) mixing the processed signals to produce the surround sound signal.

Preferably, the processing includes: (a) filtering the L and R input signals; (b) controlling a dynamic range of the filtered signals; and (c) amplifying the processed signals.

Preferably, the signals are processed by any one selected from the group: a high pass filter, a low pass filter, all pass filter, an equaliser, and a dynamic range control.

Preferably, the left channel signal is split into a first portion and a second portion. More preferably, the first portion signal is processed by a high pass filter, an equaliser, an all pass filter and a dynamic range control; and the second portion signal is processed by a high pass filter, an equaliser, a low pass filter and a dynamic range control.

Preferably, the processed left and right channel signals are channelled to left and right drivers respectively. More preferably, the processed right channel signal is channelled to the right driver out of phase to the processed left channel signal channelled to the right driver.

Preferably, the high pass filter filters the signal at a cut-off frequency of 70-200 Hz.

Preferably, the high pass filter filters the signal at a cut-off frequency of 200 Hz.

Preferably, the low pass filter filters the signal at a cut-off frequency of 1200 Hz.

Preferably, the audio signals are transmitted to the speaker wirelessly.

Preferably, a portion of the left channel signal and right channel signal is transmitted to a sub-woofer unit.

Preferably, the signals received by the sub-woofer unit are processed by any one selected from the group: a high pass filter, a low pass filter, an equaliser, and a dynamic range control.

Preferably, the low pass filter filters the signal at a cut-off frequency of 70-200 Hz.

Preferably, the signals are transmitted to the sub-woofer unit wirelessly.

In accordance with a third aspect of the present invention, there is provided a surround sound system, the system comprising a transmitter for transmitting a left channel (L) signal and a right channel (R) signal to a speaker according to the first aspect of the present invention.

Preferably, the system comprises 7 speakers.

Preferably, the speakers are located in a single speaker enclosure.

BRIEF DESCRIPTION OF FIGURES

In order that the present invention may be fully understood and readily put into practical effect, there shall now be described by way of non-limitative examples only preferred embodiments of the present invention, the description being with reference to the accompanying illustrative figures.

In the Figures.

DETAILED DESCRIPTION OF THE PREFERRED EMBODIMENTS

Figure 1:
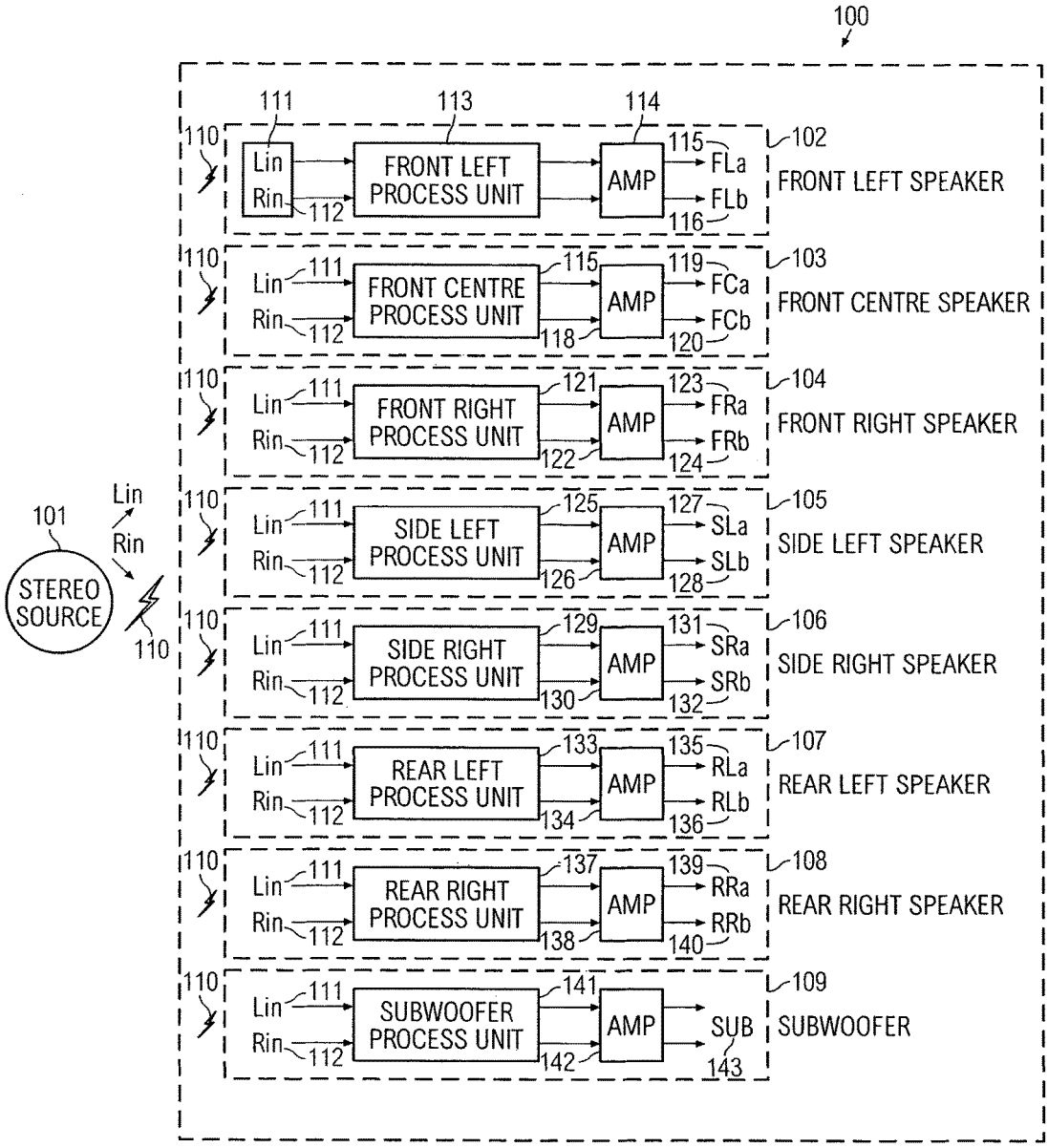
FIG. 1 shows a schematic diagram of the system according to an embodiment of the invention.

FIG. 1 shows a surround sound system 100 according to an embodiment. The system 100 may be wired or without wire. In other words, the transmission of audio signals in the system 100 may be carried out by means of a wire or by any wireless means known to the skilled person. The system 100 has a signal source 101 wirelessly connected to a plurality of speakers, and a subwoofer 109 for surround sound generation. The signal source 101 may be a stereo source 101. The speakers include a front left speaker 102, a front center speaker 103, a front right speaker 104, a side left speaker 105, a side right speaker 106*m* a rear left speaker 107, a rear right speaker 108. The stereo source 101 is capable of generating stereo audio signals such as two channel stereo input signals namely, a left channel input signal 111 and a right channel input signal 112.

In the front left speaker 102, there is a wireless receiver for receiving the left channel input signal 111 and the right channel input signal 112, a front left processing unit 113, and an amplifier unit 114.

Similarly, the front center speaker 103 has a wireless receiver for receiving the left channel input signal 111 and the right channel input signal 112, a front center processing unit 117, and an amplifier unit 118.

The front right speaker 104 has a wireless receiver for receiving the left channel input signal 111 and the right channel input signal 112, a front right processing unit 121, and an amplifier unit 122.

The side left speaker 105 has a wireless receiver for receiving the left channel input signal 111 and the right channel input signal 112, a side left processing unit 125, and an amplifier unit 126.

The side right speaker 106 has a wireless receiver for receiving the left channel input signal 111 and the right channel input signal 112, a side right processing unit 129 and an amplifier unit 130.

The rear left speaker 107 has a wireless receiver for receiving the left channel input signal 111 and the right channel input signal 112, a rear left processing unit 133, and an amplifier unit 134.

The rear right speaker 108 has a wireless receiver for receiving the left channel input signal 111 and the right channel input signal 112, a rear right processing unit 137, and an amplifier unit 138.

The subwoofer 109 has a wireless receiver for receiving the left channel input (Lin) signal 111 and the right channel input (Rin) signal 112, a subwoofer processing unit 141, and an amplifier unit 142. In all embodiments, the subwoofer 109 is used for generating low frequency components of the input signals 111, 112 to be sent to all the speakers 102, 103, 104, 105, 106, 107, 108 which are connected wirelessly to the subwoofer 109.

In the above speakers 102, 103, 104, 105, 106, 107, 108 and subwoofer 109, the wireless receiver may be a Blue Tooth interface and configured within the respective processing unit of the speakers 102, 103, 104, 105, 106, 107, 108 and subwoofer 109.

Front Right Process Unit

FIGS. 2A to 2D illustrate a front right (FR) process unit 121 of the front right (FR) speaker 104 according to an embodiment.

Figure 2A:
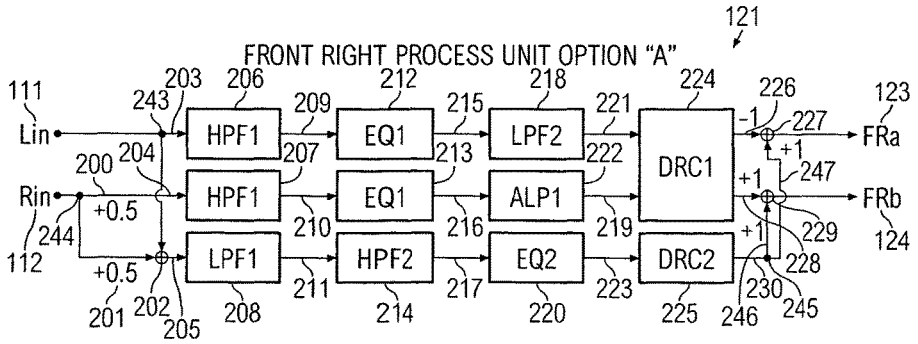
FIG. 2A shows a block diagram of the components of a front right processing unit according to an embodiment of the invention.

FIG. 2A shows a block diagram of the components of a front right (FR) process unit 121 (Option 'A') for generating a first front right (FR) signal 123 and a second front right (FR) signal 124. The FR process unit 121 is configured to receive the Lin and Rin signals 111, 112 wirelessly, and process the L and R signals separately and independently, and eventually produce the output which is the surround sound signal comprising first front right (FR) signal 123 and a second front right (FR) signal 124. The Lin signal 111 is divided or split into a first signal 203 and a second signal 204 at node 243.

Figure 2B:
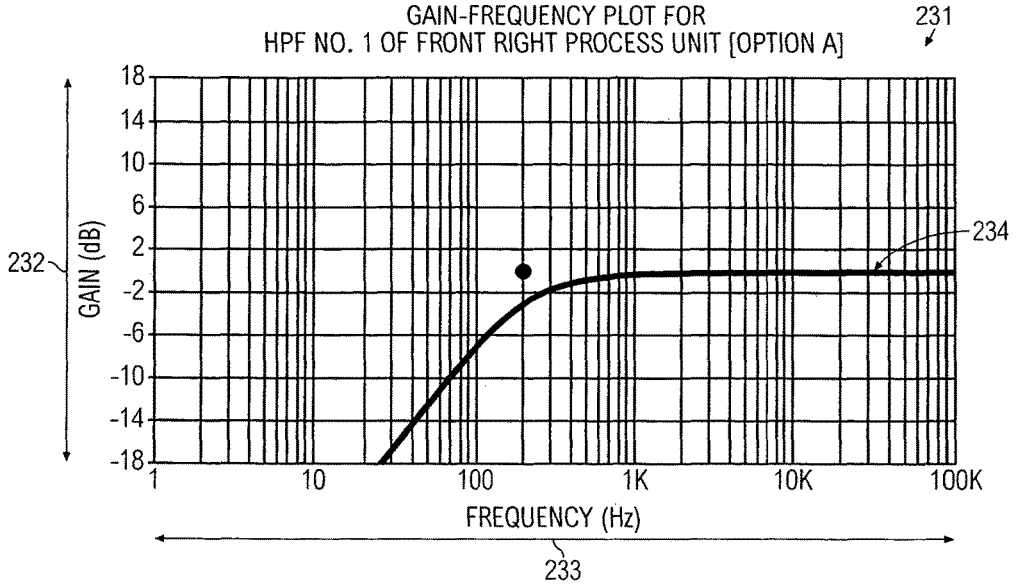
FIG. 2B shows a gain-frequency plot for a high pass filter of the front right processing unit of FIG. 2A.

In a separate signal path, the first signal 203 of the Lin signal 111 is passed through a series of components consisting of: a first High Pass Filter (HPF1) 206, a first Equalization Filter (EQ1) 212, a second Low Pass Filter (LPF2) 218, and a first Dynamic Range Control (DRC1) 224. The amplitude of low frequency components of the first signal 203 are attenuated by the HPF1 (206). In particular, FIG. 2B shows a gain—frequency plot 231 of the HPF 206 which illustrate a curve 234. The curve 234 shows that the HPF1 (206) has a cut-off frequency of 70 to 200 Hz. In other words, the amplitude or gain of frequency components having a frequency of 70 to 200 Hz in the first signal 203 will be reduced to generate a filtered signal 209.

Figure 2C:
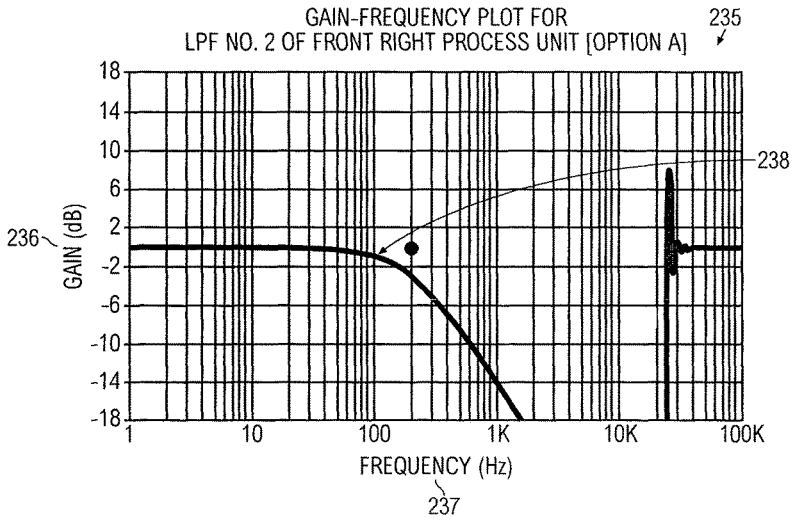
FIG. 2C shows a gain-frequency plot for a first low pass filter of the front right processing unit of FIG. 2A.

After the low frequency components are filtered, the filtered signal 209 is then directed to the EQ1 (212) for adjusting of the high frequency components of the filtered signal 209 to generate an equalized signal 215. The equalized signal 215 is passed to the LPF2 (218) having a cut-off frequency of 1200 Hz. FIG. 2C show a gain-frequency plot 235 of the LPF2 (218) having a curve 238 for the LPF2 (218) showing the cut-off frequency of 1200 Hz. As such, the gain of frequencies above 1200 Hz in the equalized signal 215 will be reduced to generate a second filtered signal 221. The second filtered signal 221 is passed to the DRC1 (224) to apply an appropriate gain so as to generate a first processed signal 226.

Similar to the processing of the Lin signal 111, the Rin signal 112 is divided into a third signal 200 and a fourth signal 201 at node 244.

In a separate signal path, the third signal 200 is passed through a series of components for digital signal processing in the same way as the series of components for the first signal 203. In particular, the third signal is passed through the series of components consisting of: a first High Pass Filter (HPF1) 207, a first Equalization Filter (EQ1) 212, a first All Pass Filter (APF1) 219, and a first Dynamic Range Control (DRC1) 224. The ALP1 (219) is used in the processing of the third signal 200 to optimise phase response to give better centre positioning focusing. In the digital signal processing process, the third signal 200 is processed to generate a second processed signal 228 which is connected out of phase with the first processed signal 226.

Figure 2D:
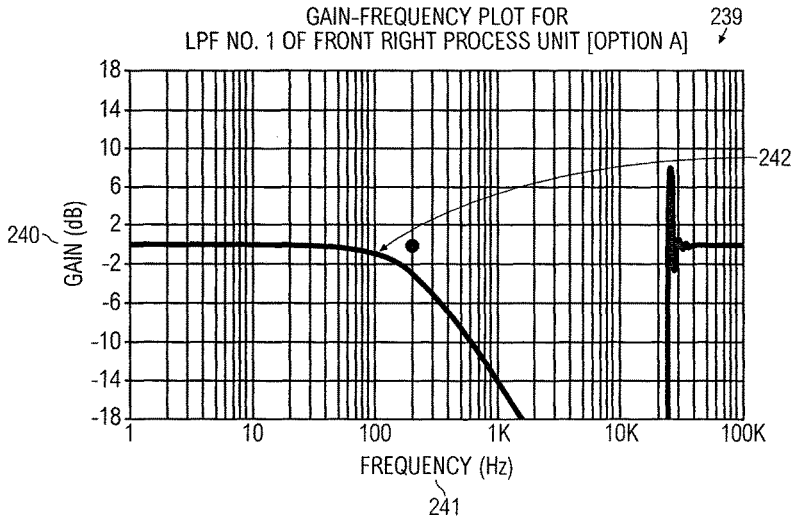
FIG. 2D shows a gain-frequency plot for a second low pass filter of the front right processing unit of FIG. 2A.

With regards to the subwoofer, the second signal 204 (0.5 of the Lin signal 111) and the fourth signal 201 (0.5 of the Rin signal 112) are passed to an adder/summation block 202 to be added to generate a subwoofer signal 205. The subwoofer signal 205 is passed through a series of components consisting of: first Low Pass Filter (LPF1) 208, a High Pass Filter (HPF2) 214, a second Equalizer Filter (EQ2) 220, and a second Dynamic RANGE Control (DRC2) 225. FIG. 2D shows a gain-frequency plot 239 for the LPF1 (208). The plot 239 has a curve 242 which shows that the LPF1 (208 has a cut-off frequency of 1200 Hz. It is appreciated that the LPF1 (208), the HPF2 (214), the EQ2 (220) and the DRC2 (225) are used in the same way as the series of components for the first signal 203 of the Lin signal 111. After processing, a third processed signal 230 is generated.

Figure 7:
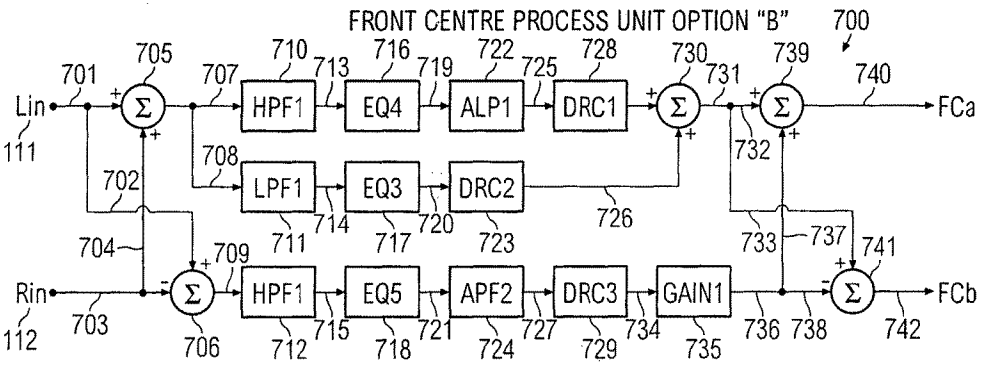
FIG. 7 shows a block diagram of the components for a front center processing unit according to an embodiment.

The third processed signal 230 is divided at node 245 into a first subwoofer processed signal 246 and a second subwoofer processed signal 247. The subwoofer signal is processed a similar way for all of the speakers in the surround system. In a front center speaker, the gain of the subwoofer signal may be adjusted or increased after a dynamic range control as shown in FIG. 7.

The second subwoofer processed signal 247 and the first processed signal 226 are passed to an adder block 227 to be added to generate the first front right (FR) signal 123. In this manner, the first processed signal 226 and the second subwoofer processed signal 247 can be mixed to generate the first front right (FR) signal 123 which can be an example of the aforementioned "surround sound signal". The first subwoofer processed signal 246 and the second processed signal 228 are passed to an adder block 229 to generate the second front right (FR) signal 124. In this manner, the first subwoofer processed signal 246 and the second processed signal 228 can be mixed to generate the second front right (FR) signal 124 which can be an example of the aforementioned "surround sound signal".

Figure 3:
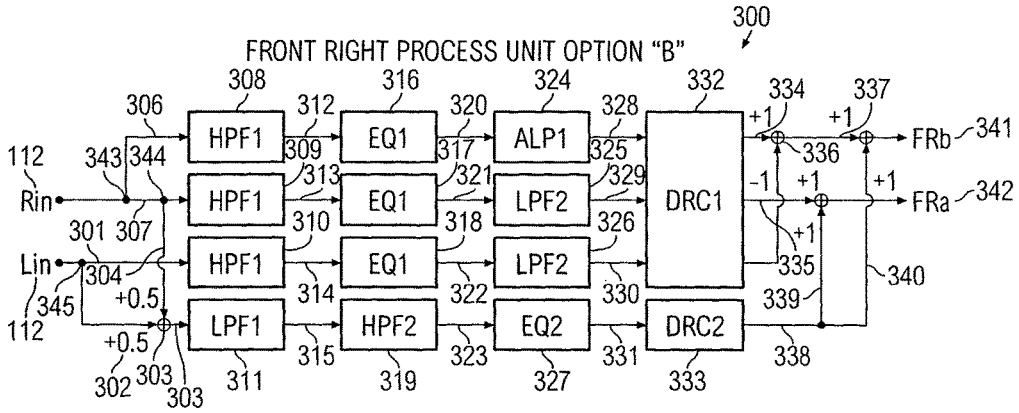
FIG. 3 shows a block diagram of the components of a front right processing unit according to an embodiment.

FIG. 3 show an embodiment of the front right process unit 300 of the front right speaker 104. It is appreciated that the front right process unit 300 is the same as the front right process unit 121 of FIG. 2A except that the Rin signal 112 is divided at node 343, and later node 344 into three signals, namely, a first signal 306, a second signal 307 and a third signal 304. The three signals are processed individually in the same way as the first signal 203 and the third signal 200 of the front right process unit 121 of FIG. 2A. The first signal 306 and the second signal 307 of the Rin signal 112 are processed to generate a first processed signal 334 and a second processed signal 335. The Lin signal 111 is divided at node 345 into a fourth signal 301 and a fifth signal 302. The fourth signal 301 and the fifth signal 302 are processed individually in the same way as the third signal 200 and the fourth signal 201 of the front right process unit 121 of FIG. 2A. In this regard, where appropriate, the foregoing discussed with regard to FIG. 2A analogously applies.

Front Left Process Unit

FIGS. 4A to 4D illustrate a front left (FL) process unit 400 of the front right (FL) speaker 102 according to an embodiment.

Figure 4A:
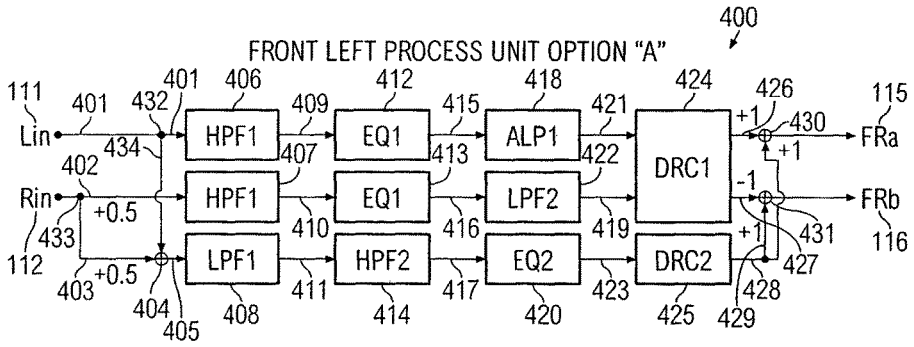
FIG. 4A shows a block diagram of the components of a front left processing unit according to an embodiment.

FIG. 4A shows a block diagram of the components of a front left (FL) process unit 400 (Option 'A') for generating a first front left (FL) signal 115 and a second front left (FL) signal 116. The FL process unit 400 is configured to receive the Lin and Rin signals 111, 112 wirelessly, and process the L and R signals separately and independently, and eventually produce the output which is the surround sound signal comprising first front left (FL) signal 115 and a second front left (FL) signal 116. The Lin signal 111 is divided or split into a first signal 401 and a second signal 434 at node 432. The Rin signal 112 is divided into a third signal 402 and a fourth signal 403 at node 433.

The first signal 401 is passed through a series of components for digital signal processing consisting of: a first High Pass Filter (HPF1) 406, an Equalizer Filter (EQ1) 412, a first All Pass Filter (ALP1) 418, and a first Dynamic Range Control (DRC1) 424. The third signal 402 of the Rin signal 112 is passed through a series of components for digital signal processing consisting of: a first High Pass Filter (HPF1) 407, an Equalizer Filter (EQ1) 413, a second Low Pass Filter (LPF2) 419, and a Dynamic Range Control (DRC1) 424.

The Lin and Rin signals 111, 112 are processed in the same way as the Lin and Rin signals in the FR process unit (121, 300) to generate a first front left (FL) signal 115 and a second front left (FL) signal 116 except that in the FL process unit 400; there is a switch over in components, i.e. the first All Pass Filter (ALP1) 418 and the second Low Pass Filter (LPF2) 419. This means that first signal 401 of the front left (FL) process unit 400 will be passed to the ALP1 (418) instead of the LFP2 (419) when front left (FL) process unit 400 is activated. When the front left process unit 400 is activated, the first signal 401 of the Lin signal 111 is driving the ALP1 (418). The ALP1 (418) is used to optimise phase response to give better centre positioning focusing.

With regards to the subwoofer, the second signal 434 (0.5 of the Lin signal 111) and the fourth signal 403 (0.5 of the Rin signal 112) are passed to an adder/summation block 404 to be added to generate a subwoofer signal 405. The subwoofer signal 405 is passed through a series of components consisting of: first Low Pass Filter (LPF1) 408, a High Pass Filter (HPF2) 414, a second Equalizer Filter (EQ2) 420, and a second Dynamic Range Control (DRC2) 425. FIG. 4D shows a gain-frequency plot 239 for the LPF1 (408). The plot 239 has a curve 443 which shows that the LPF1 (408) has a cut-off frequency of 1200 Hz. It is appreciated that the LPF1 (408), the HPF2 (414), the EQ2 (420) and the DRC2 (425) are used in the same way as the series of components for the subwoofer signal 205 of the FR processing unit 121 of FIG. 2A. The subwoofer signal is processed in a similar way for all of the speakers in the surround system.

In this regard, where appropriate, the foregoing discussed with regard to FIG. 2A analogously applies.

Figure 4B:
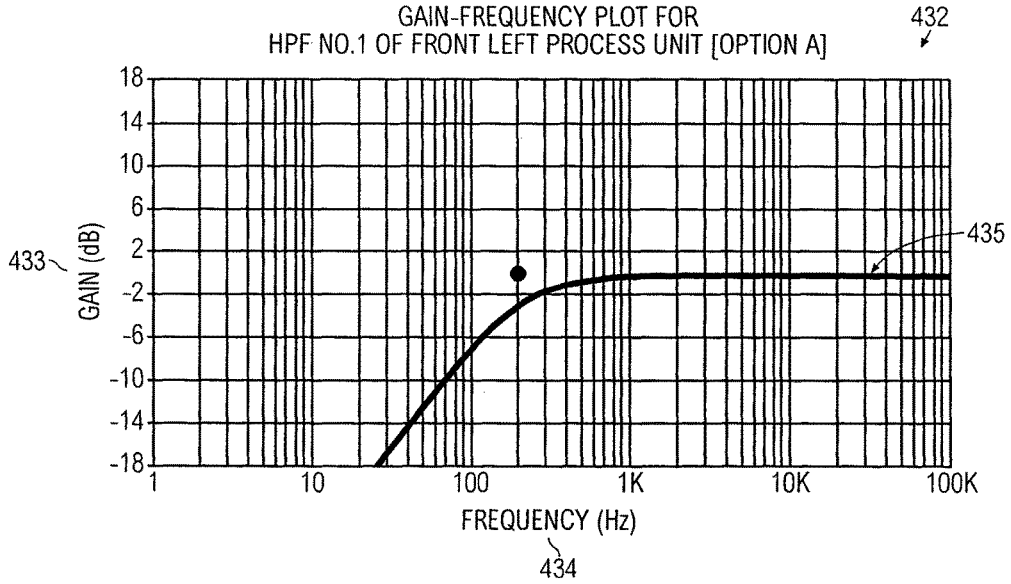
FIG. 4B shows a gain-frequency plot for a high pass filter of the front left processing unit of FIG. 4A.

FIG. 4B show a gain-frequency plot 432 for the HPF1 (406) of the FL process unit 400. The plot 432 shows a curve 435 which indicates that the cut-off frequency of the HPF1 (406) is 200 Hz.

Figure 4C:
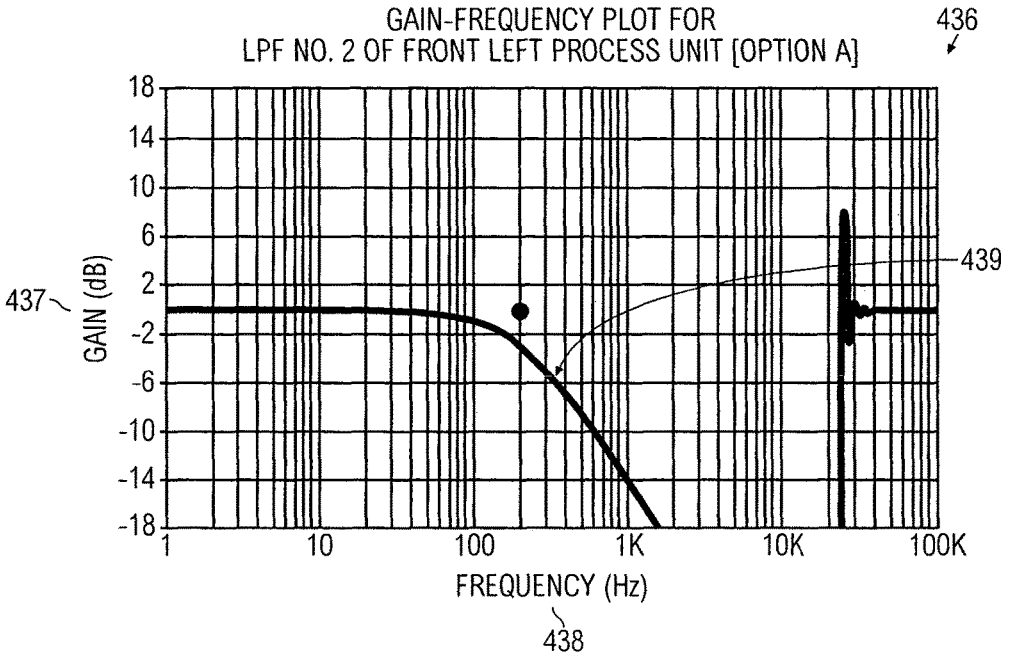
FIG. 4C shows a gain-frequency plot for a first low pass filter of the front left processing unit of FIG. 4A.
Figure 4D:
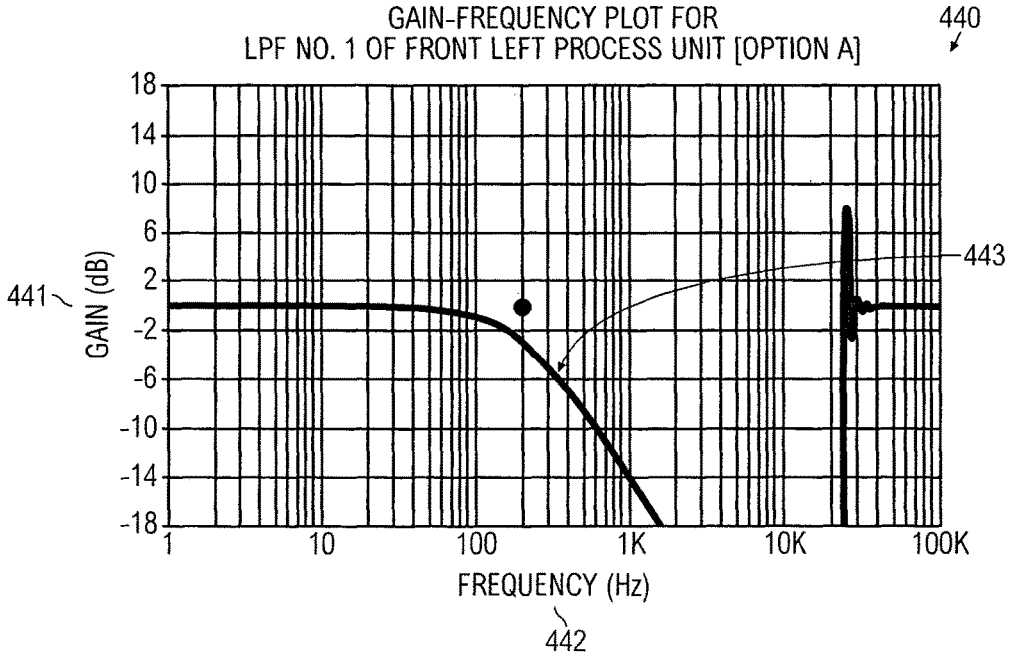
FIG. 4D shows a gain-frequency plot for a second low pass filter of the front left processing unit of FIG. 4A.

FIG. 4C show a gain-frequency plot 436 for the LPF2 (419) of the FL process unit 400. The plot 436 shows a curve 439 which indicates that the cut-off frequency of the LPF2 (419) is 1200 Hz.

Figure 5:
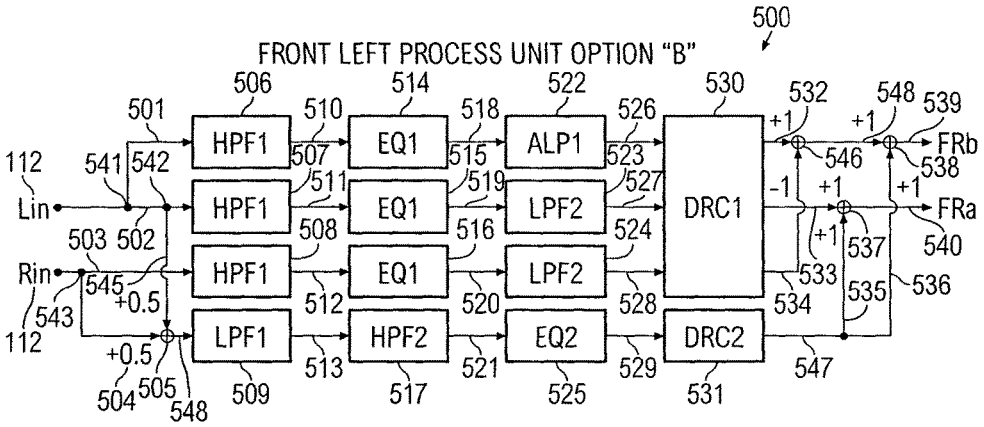
FIG. 5 shows a block diagram of the components of a front left processing unit according to an embodiment.

FIG. 5 show an embodiment of a front left (FL) process unit 500 of the front left speaker 102. It is appreciated that the front left process unit 500 is the same as the front left process unit 400 of FIG. 4A except that the Lin signal 111 is divided at node 541 into first signal 501 and second signal 502, and later at node 542 into two signals, namely, a third signal 545 and a fourth signal 546. The three signals (501, 545, 546) are processed individually in the same way as the signals of the front left process unit 300 of FIG. 4A. In this regard, where appropriate, the foregoing discussed with regard to FIG. 4A analogously applies.

Front Center Process Unit

Figure 6A:
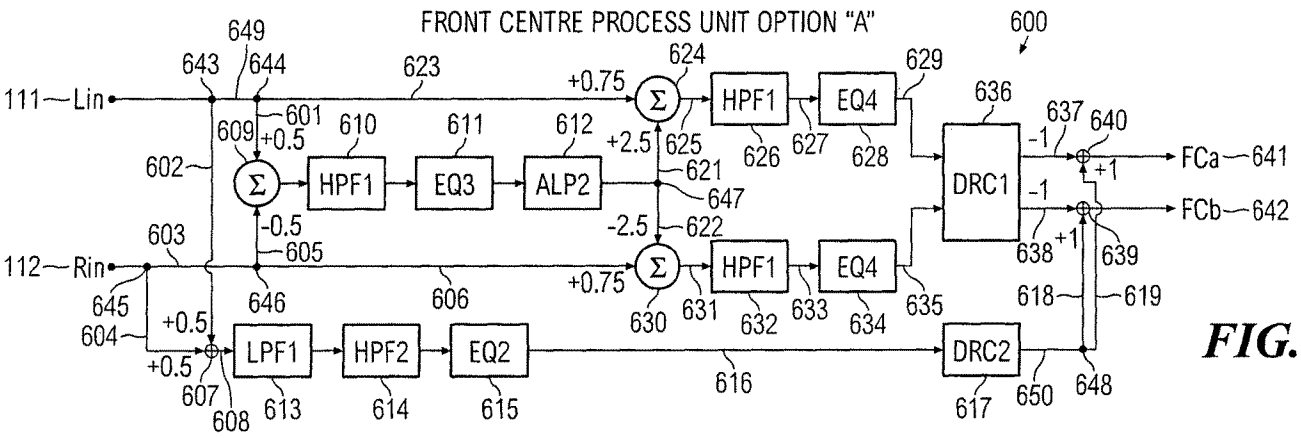
FIG. 6A shows a block diagram of the components for a front center processing unit according to an embodiment.

FIG. 6A show an embodiment of a front center (FC) process unit 600 of the front center speaker 103. Similar to the processing units described above, the FC process unit 600 is configured to receive the Lin and Rin signals 111, 112 wirelessly, and process the L and R signals separately and independently, and eventually produce the output which is the surround sound signal comprising first front center (FC) signal 641 and a second front center (FC) signal 642.

The Lin signal 111 is divided into a first signal 649 and a second signal 602 (0.5 of Lin signal 111) at node 643. The first signal 649 is further divided into a third signal 623 and a fourth signal 601 at node 644. The Rin signal 112 is divided into a fifth signal 603 and a sixth signal 604 (0.5 of Rin signal 112) at node 645.

The second signal 602 (0.5 of Lin signal 111) and sixth signal 604 (0.5 of Rin signal 112) are summed up at an adder block 607 to generate a subwoofer signal 608. The subwoofer signal 608 is passed through a series of components for digital signal processing consisting of: a first Low Pass Filter (LPF1) 613, a second High Pass Filter (HPF2) 614, a second Equalizer Filter (EQ2) 615, a second Dynamic Range Control (DRC2) 617 to generate a processed signal 650. The EQ2 (615) has a 12 dB boost at 180 Hz. The processed signal 650 is further divided into a first subwoofer signal 618 and a second subwoofer signal 619 at node 648.

Figure 6B:
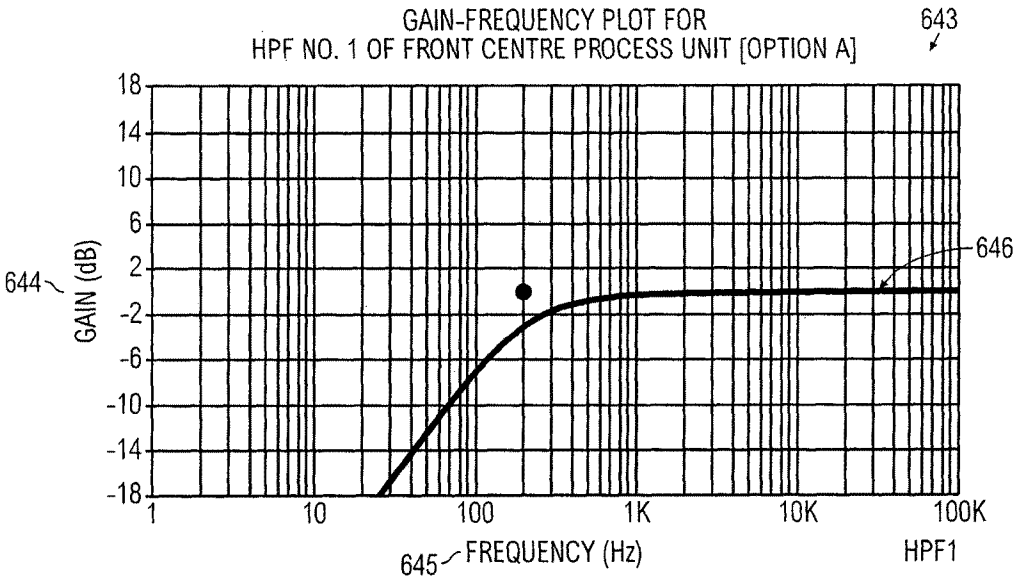
FIG. 6B shows a gain-frequency plot for a high pass filter of the front center processing unit of FIG. 6A.

In a separate signal path, the fifth signal 603 is further divided at node 644 into a seventh signal 605 and an eight signal 608. The seventh signal 605 and the fourth signal 601 are passed to an accumulator block 609 to generate a accumulated signal 645. The signal 645 is passed through a series of components consisting of: a High Pass Filter (HPF1) 626, an Equalizer Filter (EQ3) 611 and an All Pass Filter (ALP2) 612. FIG. 6B shows a gain-frequency plot 643 of the HPF1 whereby a curve 646 illustrates that the HPF1 has a cut off frequency of 180 Hz. The EQ3 (611) is catered for the driver frequency response and the ALP2 (612) is to optimize the phase difference so as to provide better focusing. After being processed by the series of components, the processed signal 620 is divided at node 647 to generate a left +0.5 input signal 621 and a right +0.5 input signal 622.

The left +0.5× input signal 621 and the right −0.5× input signal 622 are mixed with a +0.75× left signal 623 and a +0.75× right input signal 606 at an accumulator block 624, and at an accumulator block 630 respectively. With the mixing completed, a processed signal 625 is generated at the left input. The signal 625 is passed through a series of components consisting of a High Pass Filter (HPF1) 626 and an Equalizer Filter (EQ4) 628 and a Dynamic Range Control (DRC1) 636 to generate a processed signal 637. In a separate signal path at the right input, a processed signal 631 is generated after mixing and is processed in the same way as the processed signal 625. The signal 631 is passed through a series of components consisting of a High Pass Filter (HPF1) 632 and an Equalizer Filter (EQ4) 634 and a Dynamic Range Control (DRC1) 636 to generate a processed signal 638. The EQ 4 (628, 634) enhances the mid frequency to give a better defined vocal scene.

The processed signal 637 and the second subwoofer signal 619 is passed to an adder block 640 to generate a first Front Center (FC) signal 641. The processed signal 638 and the first subwoofer signal 618 is passed to an adder block 639 to generate a second Front Center (FC) signal 642.

FIG. 7 shows an embodiment of the Front Center (FC) Process Unit (Option B) 700. The FC process unit 700 processes the Lin signal 111 and the Rin signal 112 in a similar way to the FC process unit 600 of FIG. 6A except that there is further mixing after a dynamic range control of the respective signals and the subwoofer signal is also mixed after digital signal processing.

Side Right Process Unit

Figure 8:
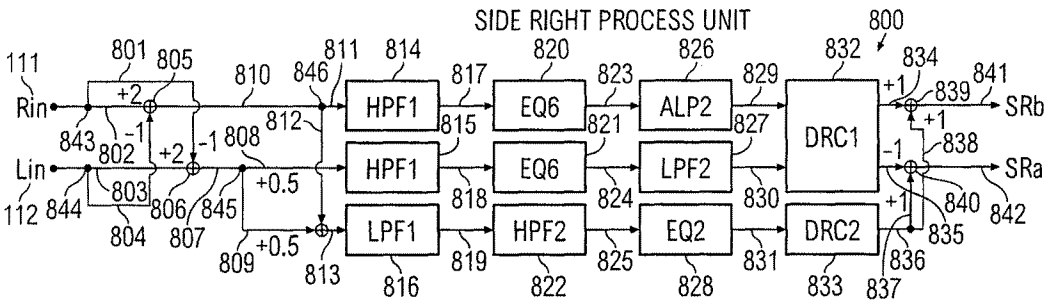
FIG. 8 shows a block diagram of the components for a side right processing unit according to an embodiment.

FIG. 8 shows a block diagram of the components of a side right (SR) process unit 800 of the side right (SR) speaker 106 according to an embodiment.

The side right (SR) process unit 800 generates the output surround sound signal comprising a first side right (SR) signal 841 and a second side right (SR) signal 842. The SR process unit 800 is configured to receive the Lin and Rin signals 111, 112 wirelessly, and process the L and R signals separately and independently, and eventually produce the output which is the surround sound signal comprising first side right (SR) signal 841 and a second side right (SR) signal 842. The Lin signal 111 is divided or split into a first signal 801 and a second signal 802 (+2L−R) at node 843. The Rin signal 112 is divided into a third signal 803 and a fourth signal 804 at node 844.

The second signal 802 and the fourth signal 804 is added at an adder block 805 to generate a fifth signal 810. In particular, the fifth signal 810 is further divided at node 846 into a sixth signal 811 and a seventh signal 812. The sixth signal 811 is passed though a series of components consisting of: a first High Pass Filter (HPF1) 814, a sixth Equalization Filter (EQ6) 820, a first All Pass Filter (APF1) 826, and a first Dynamic Range Control (DRC1) 832. The amplitude of low frequency components of the signal 811 are attenuated by the HPF1 (814). After the low frequency components are filtered, the filtered signal 817 is then directed to the EQ6 (820) for adjusting of the high frequency components of the filtered signal 817 to generate an equalized signal 823. The equalized signal 823 is passed to the ALP1 (826) to generate a second filtered signal 829. The ALP1 (826) is used in the processing of the signal 823 to optimise phase response to give better centre positioning focusing. The second filtered signal 829 is passed to the DRC1 (832) to apply an appropriate gain so as to generate a first processed signal 834 (+1).

In a separate signal path, the third signal 803 is passed through a series of components for digital signal processing in the same way as the series of components for the first signal 801. In particular, the third signal 803 and the signal 801 are passed to an adder block 806 to generate a signal 807. The signal 807 is divided at node 845 into a first signal 808 and a second signal 809. The first signal 808 is passed through the series of components consisting of: a first High Pass Filter (HPF1) 815, a first Equalization Filter (EQ6) 821, a Low Pass Filter (LPF2) 827, and a first Dynamic Range Control (DRC1) 832 to generate a second processed signal 835 which is out of phase with the first processed signal 834.

With regards to the subwoofer, the second signal 809 (0.5 of the signal 807) and the signal 812 (0.5 of the signal 810) are passed to an adder/summation block 847 to be added to generate a signal 813. The signal 813 is passed through a series of components consisting of: first Low Pass Filter (LPF1) 816, a High Pass Filter (HPF2) 822, a second Equalizer Filter (EQ2) 828, and a second Dynamic Range Control (DRC2) 833. After processing, a subwoofer signal 837 is generated and is divided at node 850 into a first subwoofer processed signal 837 and a second subwoofer processed signal 838.

The second subwoofer processed signal 838 and the first processed signal 834 are passed to an adder block 839 to generate the first side right (SR) signal 841. The first subwoofer processed signal 837 and the second processed signal 835 are passed to an adder block 840 to generate the second side right (SR) signal 842.

Side Left, Rear Right and Rear Left Process Units

Figure 9:
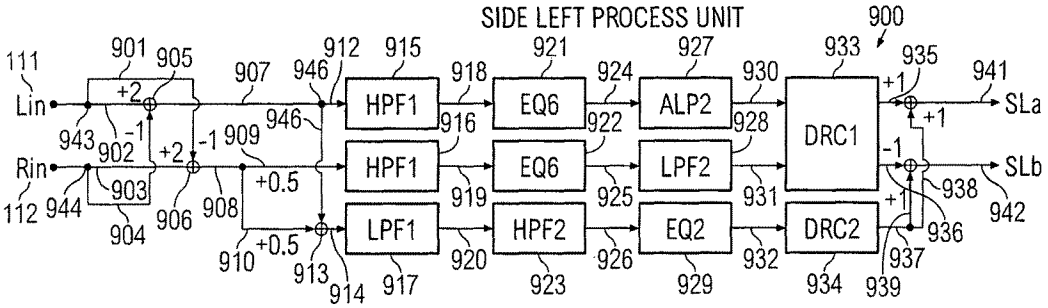
FIG. 9 shows a block diagram of the components for a side left processing unit according to an embodiment.
Figure 10:
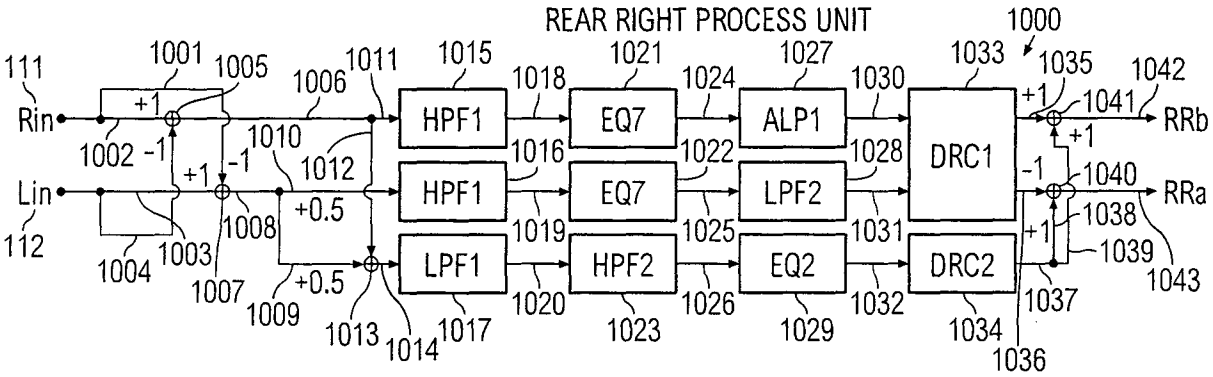
FIG. 10 shows a block diagram of the components for a rear right processing unit according to an embodiment.
Figure 11:
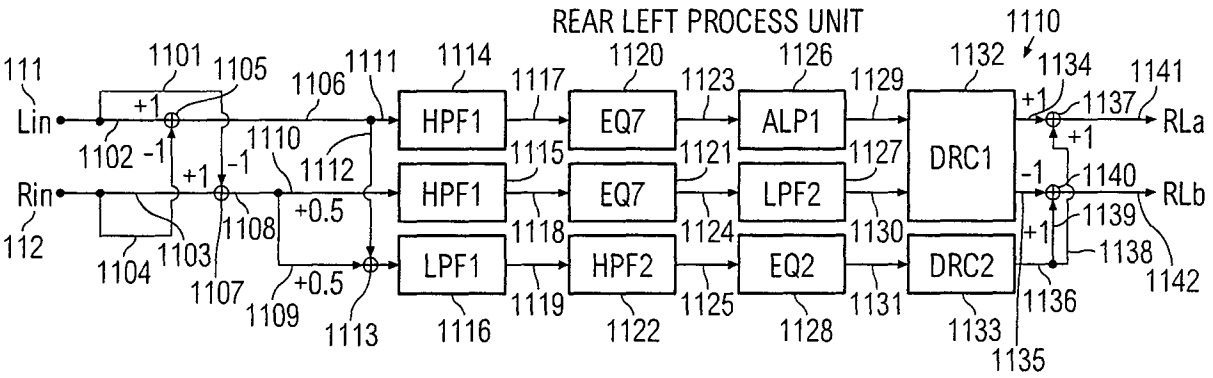
FIG. 11 shows a block diagram of the components for a rear left processing unit according to an embodiment.

FIGS. 9, 10 and 11 illustrate a side left (SL) 900, rear right (RR) 1000 and rear left (RL) 1100 process units respectively. The signal processing in each process unit is similar to that description in FIG. 8 for the side right (SR) process unit 800.

In an alternative embodiment of the invention, the speaker is capable of having placement information associated with a placement of the speaker within a surround sound environment. The speaker is then capable of producing a placement specific output signal associated with the placement of the speaker within the surround sound environment. The speaker of this embodiment will have a processing unit capable of carrying out the processing of audio signals described above. However, in addition to the above description, the processing unit is further configured to process the received audio signal including the L signal component and the R signal component in association with the placement information to produce the placement specific output signal. This requires the placement information to be received by the processing unit from an external source based on a unique identifier associated with the receiver. The placement information may include a relative placement of the speaker compared to one or more additional speakers placed within the surround sound environment.

Appreciably, where similar, the foregoing discussed with regard to FIG. 2A and/or FIG. 4A applies analogously to FIG. 5 to FIG. 11 as appropriate.

Whilst there has been described in the foregoing description preferred embodiments of the present invention, it will be understood by those skilled in the technology concerned that many variations or modifications in details of design or construction may be made without departing from the present invention.

The invention claimed is:

1. A speaker for generating a surround sound signal, the speaker comprising:

a processing unit configured for:

(a) receiving an audio signal having a left channel (L) signal and a right channel (R) signal;

(b) processing separately and independently the L and R signals to produce processed L and R signals; and (c) mixing the processed L and R signals to produce the surround sound signal, and a subwoofer unit comprising a low frequency effects channel formed by a combination of the received L and R signals, wherein the subwoofer unit produces a first subwoofer processed signal and a second subwoofer processed signal, wherein mixing the processed L and R signals comprises:

mixing the processed L signal with the first subwoofer processed signal; and mixing the processed R signal with the second subwoofer processed signal, and wherein the surround sound signal is generated based on at least one of mixing the processed L signal with the first subwoofer processed signal and mixing the processed R signal with the second subwoofer processed signal.

2. The speaker according to claim 1, wherein the left channel signal has a junction which splits the left channel signal into a first portion and a second portion; and wherein the first portion signal is processed by a high pass filter, an equalizer, an all pass filter and a dynamic range control; and the second portion signal is processed by a high pass filter, an equalizer, a low pass filter and a dynamic range control.

3. The speaker according to claim 1, wherein the speaker comprises left and right drivers, and the processed left and right channel signals are channeled to left and right drivers respectively; and wherein the processed right channel signal channeled to the right driver is out of phase to the processed left channel signal channeled to the left driver.

4. The speaker according to claim 2, wherein the high pass filter is configured to have a cut-off frequency of 70-200 Hz.

5. The speaker according to claim 2, wherein the low pass filter is configured to have a cut-off frequency of 1200 Hz.

6. The speaker according to claim 1, wherein the subwoofer unit comprises a processing unit including any one selected from the group: a high pass filter, a low pass filter, an equalizer, and a dynamic range control.

7. The speaker according to claim 6, wherein the low pass filter has a cut-off frequency of 70-200 Hz.

8. The speaker according to claim 1, wherein the subwoofer unit has 12 dB boost at about 180 Hz.

9. A surround sound system, the system comprising a transmitter for transmitting the audio signal to the speaker according to claim 1.

10. The system according to claim 9, wherein the system comprises 7 speakers.

11. The system according to claim 10, wherein the speakers are located in a single speaker enclosure.

12. The speaker according to claim 1, wherein mixing the processed L and R signals comprises:

mixing, by addition via an adder block, the processed L signal with the first subwoofer processed signal, and mixing, by addition via another adder block, the processed R signal with the second subwoofer processed signal.

13. The speaker according to claim 1, wherein processing separately and independently the L and R signals comprises processing separately and independently either a combination of or only the L and R signals to produce the processed L and R signals.

14. The system according to claim 9, wherein processing separately and independently the L and R signals comprises processing separately and independently either a combination of or only the L and R signals to produce the processed L and R signals.

15. The speaker according to claim 1, wherein the subwoofer unit comprising the low frequency effects channel formed by the combination of the L and R signals, summed to produce a main sub-woofer signal, wherein the subwoofer unit passes the main sub-woofer signal through a series of components for digital signal processing, the components comprising a Low Pass Filter, a High Pass Filter, an Equaliser Filter and a Dynamic Range Control, to generate a processed signal, wherein the processed signal is divided to produce the first subwoofer processed signal and the second sub-woofer processed signal.

16. A method for generating a surround sound signal in a speaker including a processing unit, the method comprising:

(a) receiving with the processing unit an audio signal having a left channel (L) signal and a right channel (R) signal;

(b) processing with the processing unit separately and independently the L and R signals to produce processed L and R signals;

(c) producing, based on a combination of the received L and R signals, a first subwoofer processed signal and a second subwoofer processed signal;

(d) mixing the processed L signal with the first subwoofer processed signal; and (e) mixing the processed R signal with the second subwoofer processed signal, wherein the surround sound signal is generated based on at least one of mixing the processed L signal with the first subwoofer processed signal and mixing the processed R signal with the second subwoofer processed signal.

17. The method according to claim 16, wherein processing includes:

(a) filtering the L and R signals; and (b) controlling a dynamic range of the filtered L and R signals.

18. The method according to claim 16, wherein the L and R signals are processed by any one selected from the group: a high pass filter, a low pass filter, all pass filter, an equalizer, and a dynamic range control.

19. The method according to claim 16, wherein the L signal is split into a first portion and a second portion; and wherein the first portion signal is processed by a high pass filter, an equalizer, an all pass filter and a dynamic range control; and the second portion signal is processed by a high pass filter, an equalizer, a low pass filter and a dynamic range control.

20. The method according to claim 16, wherein the processed L and R signals are channeled to left and right drivers respectively; and wherein the processed R signal is channeled to the right driver out of phase to the processed L signal channeled to the left driver.

21. The method according to claim 16, wherein a portion of the L signal and R signal is transmitted to a subwoofer unit; and wherein the signals received by the subwoofer unit are processed by any one selected from the group: a high pass filter, a low pass filter, an equalizer, and a dynamic range control.

22. The method according to claim 21, wherein the low pass filter has a cut-off frequency of 70-200 Hz.

23. The method according to claim 21, wherein the signals are transmitted to the subwoofer unit wirelessly.

24. The method according to claim 16, wherein processing separately and independently the L and R signals comprises processing separately and independently either a combination of or only the L and R signals to produce the processed L and R signals.

25. The method according to claim 16, wherein the first subwoofer processed signal and the second subwoofer processed signal are produced by processing the combination of the received L and R signals through a series of components for digital signal processing, the components selected from the group consisting of a Low Pass Filter, a High Pass Filter, an Equaliser Filter, and a Dynamic Range Control.

* * * * *